US011112749B1

(12) United States Patent
Jiang et al.

(10) Patent No.: US 11,112,749 B1
(45) Date of Patent: Sep. 7, 2021

(54) PROCESS CARTRIDGE

(71) Applicant: JIANGXI YIBO E-TECH CO. LTD., Xinyu (CN)

(72) Inventors: Peng Jiang, Xinyu (CN); Xiaobing Liu, Xinyu (CN)

(73) Assignee: JIANGXI YIBO E-TECH CO. LTD., Xinyu (CN)

( * ) Notice: Subject to any disclaimer, the term of this patent is extended or adjusted under 35 U.S.C. 154(b) by 0 days.

(21) Appl. No.: 17/229,912

(22) Filed: Apr. 14, 2021

(30) Foreign Application Priority Data

| | | |
|---|---|---|
| Jun. 30, 2020 | (CN) | 202021244613.7 |
| Jul. 20, 2020 | (CN) | 202021420423.6 |
| Aug. 8, 2020 | (CN) | 202021633928.0 |
| Apr. 2, 2021 | (CN) | 202120679210.3 |

(51) Int. Cl.
*G03G 21/16* (2006.01)
*G03G 21/18* (2006.01)
*G03G 15/00* (2006.01)

(52) U.S. Cl.
CPC ..... *G03G 21/1814* (2013.01); *G03G 15/757* (2013.01)

(58) Field of Classification Search
CPC ..... G03G 15/0891; G03G 15/757; G03G 21/1814; G03G 21/1853
See application file for complete search history.

(56) References Cited

U.S. PATENT DOCUMENTS

| | | | |
|---|---|---|---|
| 7,860,433 | B2 | 12/2010 | Toba et al. |
| 8,369,743 | B2 | 2/2013 | Maeshima et al. |
| 8,565,639 | B2 | 10/2013 | Nittani et al. |
| 8,588,646 | B2 | 11/2013 | Yoshimura et al. |
| 9,429,906 | B2 | 8/2016 | Yoshimura et al. |

(Continued)

FOREIGN PATENT DOCUMENTS

| | | | |
|---|---|---|---|
| CN | 201229471 | Y | 4/2009 |
| CN | 1580970 | B | 5/2010 |
| CN | 101782738 | A | 7/2010 |

(Continued)

*Primary Examiner* — Hoang X Ngo
(74) *Attorney, Agent, or Firm* — IPro, PLLC

(57) ABSTRACT

Disclosed in the present invention is a process cartridge, which is detachably mounted into an electronic imaging device, wherein the electronic imaging device comprises a separating member. The process cartridge comprises: a photosensitive drum; a developing roller; a first housing supporting the developing roller, wherein when the process cartridge is mounted into the electronic imaging device, in a direction of gravity, the photosensitive drum is located on a lower end side of the process cartridge, and an axis of the developing roller is located on an upper side of an axis of the photosensitive drum; and an integrally molded second housing. The second housing supports the photosensitive drum. A first housing is rotatable relative to the second housing. A separating force receiving component movable relative to the second housing is provided on the second housing. The separating force receiving component receives a force from the separating member to move, and the movement of the separating force receiving component drives the first housing to move relative to the second housing, so that the developing roller is separated from the photosensitive drum.

6 Claims, 18 Drawing Sheets

(56) References Cited

U.S. PATENT DOCUMENTS

| | | | | |
|---|---|---|---|---|
| 2016/0252847 | A1* | 9/2016 | Sato | G03G 21/186 399/167 |
| 2016/0252868 | A1* | 9/2016 | Morishita | G03G 15/757 399/167 |

FOREIGN PATENT DOCUMENTS

| | | | |
|---|---|---|---|
| CN | 102968020 | A | 3/2013 |
| CN | 104298102 | A | 1/2015 |
| CN | 104583879 | A | 4/2015 |
| CN | 204731529 | U | 10/2015 |
| CN | 108333900 | A | 7/2018 |
| CN | 108762029 | A | 11/2018 |
| CN | 208255638 | U | 12/2018 |
| CN | 208477300 | U | 2/2019 |
| CN | 209606790 | U | 11/2019 |
| CN | 209746358 | A | 12/2019 |
| CN | 111190333 | A | 5/2020 |
| CN | 210534540 | U | 5/2020 |
| CN | 210666366 | U | 6/2020 |
| CN | 210742682 | U | 6/2020 |
| CN | 111413857 | A | 7/2020 |
| CN | 211123630 | U | 7/2020 |
| CN | 211653402 | U | 10/2020 |
| CN | 211698602 | U | 10/2020 |
| CN | 108255039 | B | 11/2020 |
| CN | 212009289 | U | 11/2020 |
| CN | 212181259 | U | 12/2020 |
| CN | 212569435 | U | 2/2021 |
| CN | 212569436 | U | 2/2021 |

* cited by examiner

PROCESS CARTRIDGE

TECHNICAL FIELD

The present invention relates to a process cartridge, and in particular, to a housing of the process cartridge accommodating a developer.

BACKGROUND

Generally, a general process cartridge includes a first housing for accommodating a developer to be used and a second housing for collecting the waste developer remaining after development. A developing roller, a stirring rack, and a toner supply roller are mounted on the first housing. A charging roller, a photosensitive drum and other components are mounted on the second housing. The general process cartridge is usually detachably mounted into an electronic imaging device. When imaging is required, the charging roller will apply predetermined electrostatic charges on a surface of the photosensitive drum. The photosensitive drum uses its own photosensitive characteristics to form an electrostatic latent image on the surface. The electrostatic latent image is developed by the developing roller and then transferred to an imaging medium so as to complete a development process.

In addition, in order to solve the problem of deformation of the developing roller or contamination of the photosensitive drum due to the contact of the developing roller and the photosensitive drum when the process cartridge is not working, a contact component is usually provided on the process cartridge, and the electronic imaging device can force the developing roller to separate from the photosensitive drum by driving a separating member to be in contact with the contact component and pushing the contact component.

In the process cartridge in the prior art, its first housing and second housing are connected by a protective cover that is detachably mounted on the process cartridge, and a separating force receiving component is mounted on the protective cover. This method is adopted to connect the first housing and the second housing, which requires more parts, and has a more complicated structure and an excessively high production cost.

SUMMARY

The present invention provides a process cartridge, which aims to solve the technical problems in the prior art that the process cartridge has a complicated structure, high production cost, and difficult assembly, and the contact component of the process cartridge may produce a greater friction loss with the separating member of the electronic imaging device.

In order to solve the above problems, the present invention is implemented through the following technical solutions:

A process cartridge, which is detachably mounted into an electronic imaging device, wherein the electronic imaging device comprises a separating member, a movable tray, and a main body accommodating portion, and the tray can be drawn out and pushed in from the main body accommodating portion, the process cartridge comprising:

a photosensitive drum having a photosensitive layer on its surface;

a charging roller for charging the photosensitive drum;

a developing roller for developing an electrostatic latent image formed on the surface of the photosensitive drum, which rotates around an axis extending in a first direction;

a first housing supporting the developing roller, in which an accommodating portion for accommodating a developer is provided;

a second housing supporting the photosensitive drum, wherein when the process cartridge is mounted into the electronic imaging device, in a direction of gravity, the photosensitive drum is positioned on a lower end side of the process cartridge, and an axis of the developing roller is positioned on an upper side of an axis of the photosensitive drum;

a first force receiving portion, which can receive a driving force in the electronic imaging device for driving the developing roller to rotate;

a second force receiving portion, which can receive a driving force in the electronic imaging device for driving the photosensitive drum to rotate; and a cleaning element mounted on the second housing for cleaning the developer remaining on the photosensitive drum, wherein the process cartridge further comprises a driving side cover and a separating force receiving component that can receive an external force from the outside of the process cartridge to move; a rail portion is provided on the driving side cover, and the separating force receiving component can cooperate with the rail portion to slide along the rail portion; the separating force receiving member receives the external force to slide so as to drive the first housing to move relative to the second housing, so that the developing roller is separated from the photosensitive drum; a supporting portion supporting the process cartridge is provided on the tray, and a supported portion supported by the supporting portion is provided on the process cartridge; and in the direction of gravity, the supported portion is provided between the separating force receiving component and the first force receiving portion.

the second housing comprises a main body portion integrally molded with the driving side cover, the cleaning element is mounted on the main body portion, two hollow portions are provided on the driving end cover portion, and the first force receiving portion and the second force receiving portion protrude from the two hollow portions, respectively.

The process cartridge further comprises a supporting portion for supporting the charging roller, wherein a supporting portion mounting portion for mounting the supporting portion is further provided on the second housing, and a supporting portion mounting port exposing the supporting portion mounting portion is further provided on the driving side cover.

The process cartridge further comprises a separating support, wherein a separating support mounting port is provided on the second housing, the separating support is inserted into the second housing through the separating support mounting port, and the separating support mounting port exposes the supporting portion.

A first contact portion is further provided on the separating force receiving component, an inclined surface is provided on the first contact portion, and when the process cartridge is mounted into the electronic imaging device, the inclined surface can press the separation member so that the separating member is rotated to a retracted position.

The separating force receiving component is further provided with a second contact portion for contacting the separating member and receiving a force for separating the photosensitive drum and the developing roller thereon, and the first contact portion is adjacent to the second contact portion.

After the technical solutions of the process cartridge of the present invention described above are adopted, the driving side cover and the conductive end cover portion are integrally molded with the second housing, and the sliding separating force receiving component is provided, which reduces the complexity of the structure of the process cartridge so that the connection between the first casing and the second casing is simpler and easier to operate, and reduces the parts required for the connection between the first casing and the second casing, thereby reducing the production cost of the process cartridge. At the same time, when the electronic imaging device drives the separating member to push the separating force receiving component to separate the photosensitive drum and the developing roller in the process cartridge, the position of the contact point between the separating member and the separating force receiving component remains substantially unchanged, which reduces the friction loss between the separating member and the separating force receiving component, and prolongs the service life of the separating member and the separating force receiving component.

Figure 21:
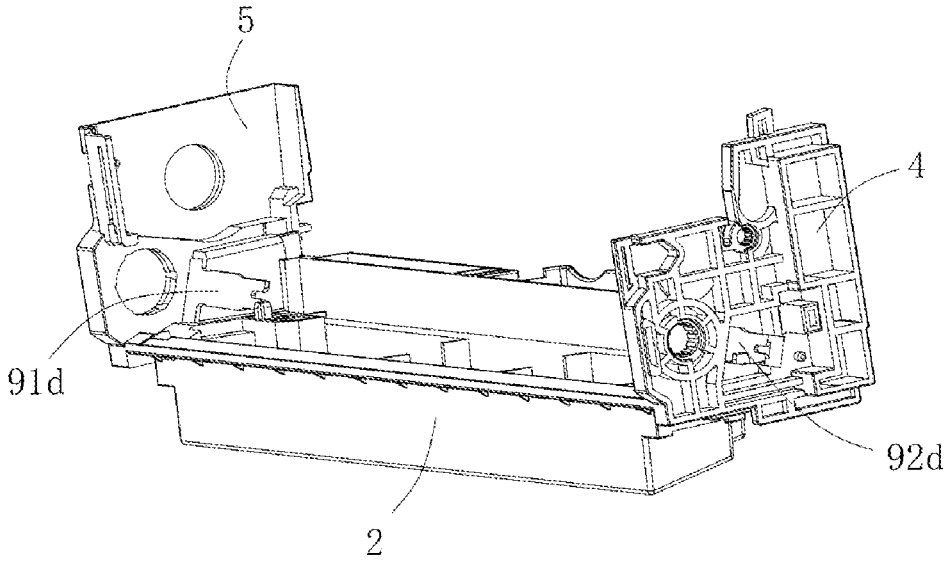
Figure 22:
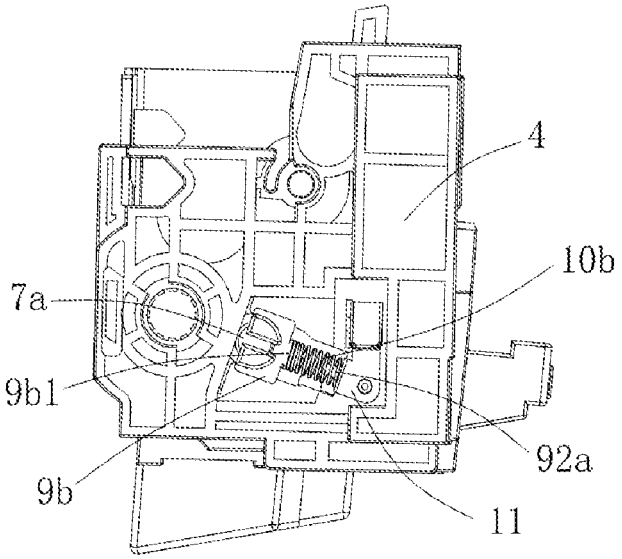
Figure 23:
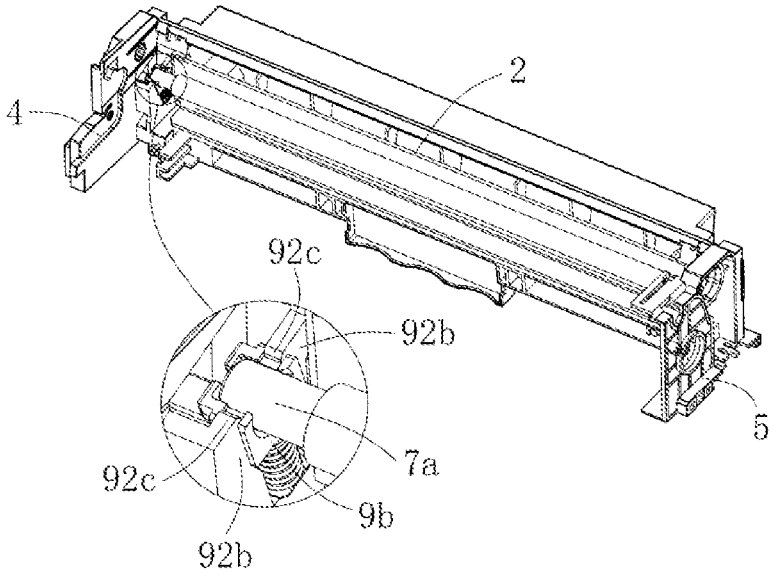
Figure 24:
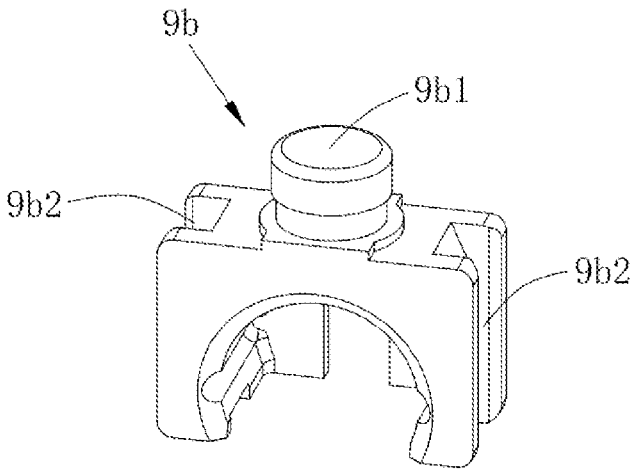
Figure 25:
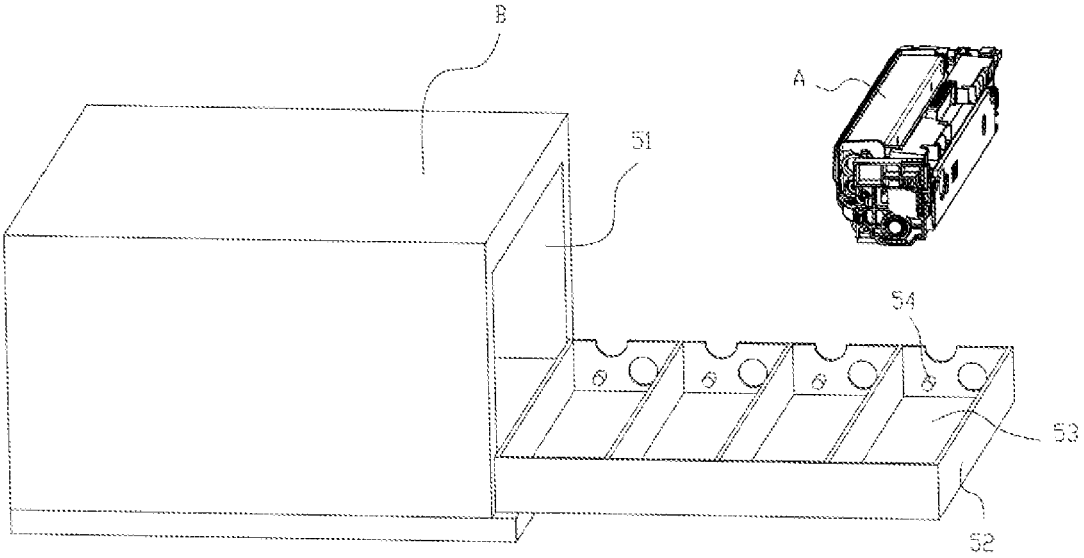
Figure 26:
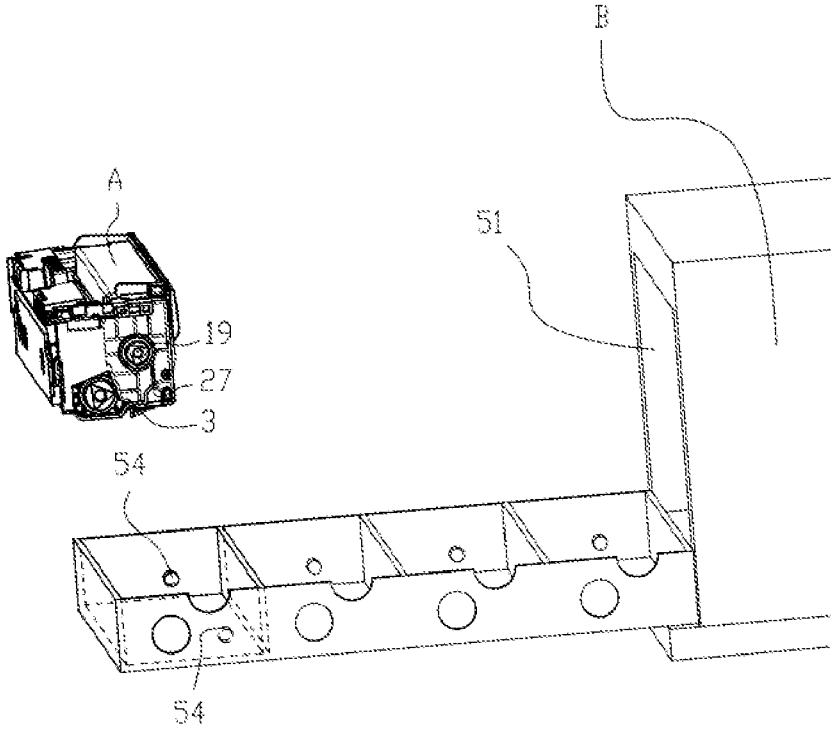
Figure 27:
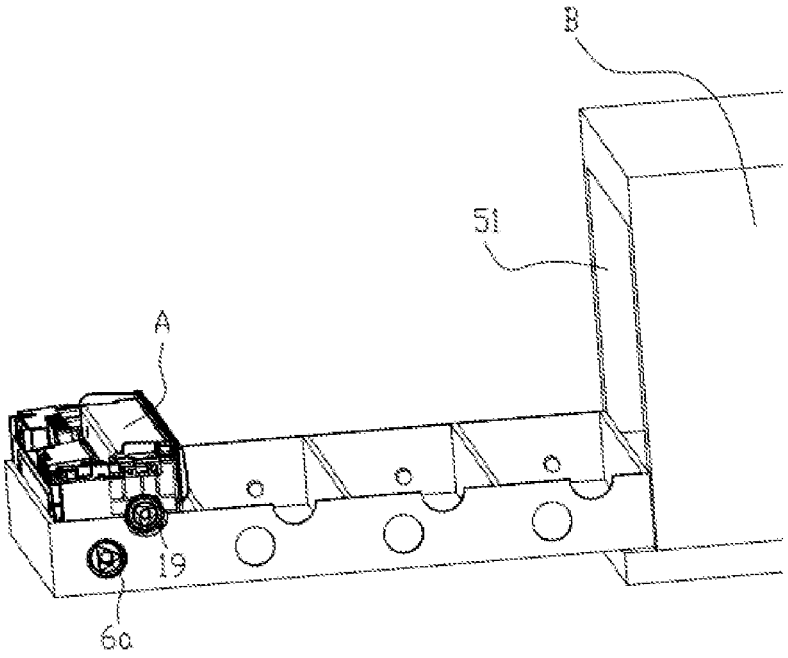

20 is an exploded schematic view of a part of the second housing and the components supported on the second housing in the present invention;

FIG. 21 is a schematic view of the second housing in the present invention;

FIG. 22 is a schematic view of the conductive end cover portion of the process cartridge of the present invention;

FIG. 23 is a partially enlarged schematic view of a second supporting portion being mounted on a second supporting portion mounting portion in the present invention;

FIG. 24 is a schematic view of the second supporting portion in the process cartridge of the present invention;

FIG. 25 is a schematic view of the process cartridge of the present invention being ready to be mounted in a tray of an imaging device;

FIG. 26 is a schematic view of the process cartridge of the present invention being ready to be mounted in the tray of the imaging device from another viewing angle; and FIG. 27 is a schematic view of the process cartridge of the present invention being mounted in the tray of the imaging device.

DETAILED DESCRIPTION

The embodiments of the present invention will be described in detail below in conjunction with the drawings. It should be understood that specific embodiments described herein are only used to explain the present invention and are not intended to limit the present invention.

In the following description, the following definitions are first made: a first force receiving portion 19 rotates around a first axis A1 extending in a first direction, a direction in which a process cartridge is mounted to a tray in an electronic imaging device is a second direction, a direction in which a separating force receiving component 3 moves in an opening portion 30 is a third direction, and a separating member 60 can move along a horizontal leftward M direction and a horizontal rightward N direction.

Process Cartridge

Figure 1:
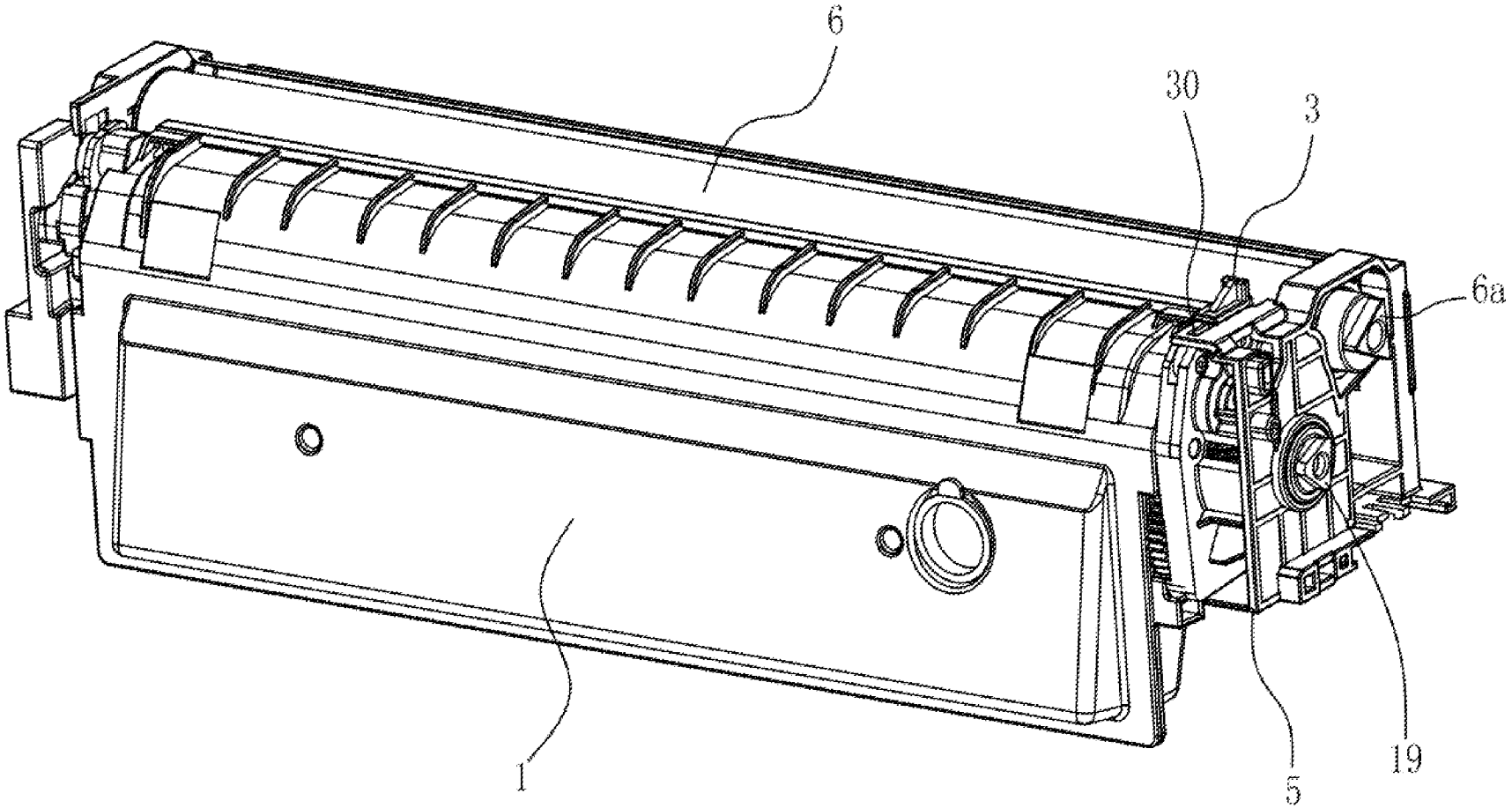
FIG. 1 is a schematic structural view of a side of a first housing of a process cartridge provided by the present invention.
Figure 2:
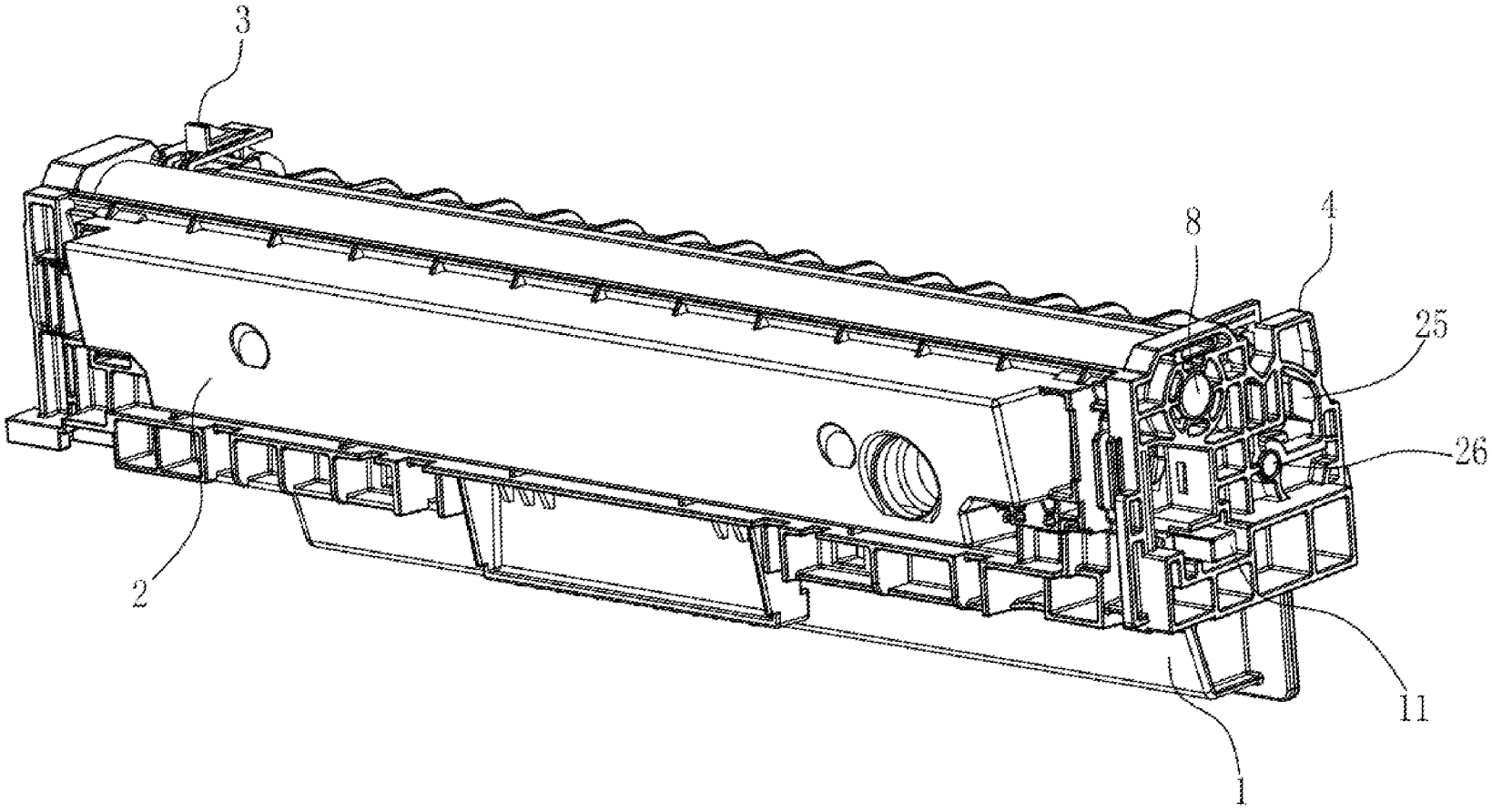
FIG. 2 is a schematic structural view of a side of a second housing of the process cartridge provided by the present invention.
Figure 3:
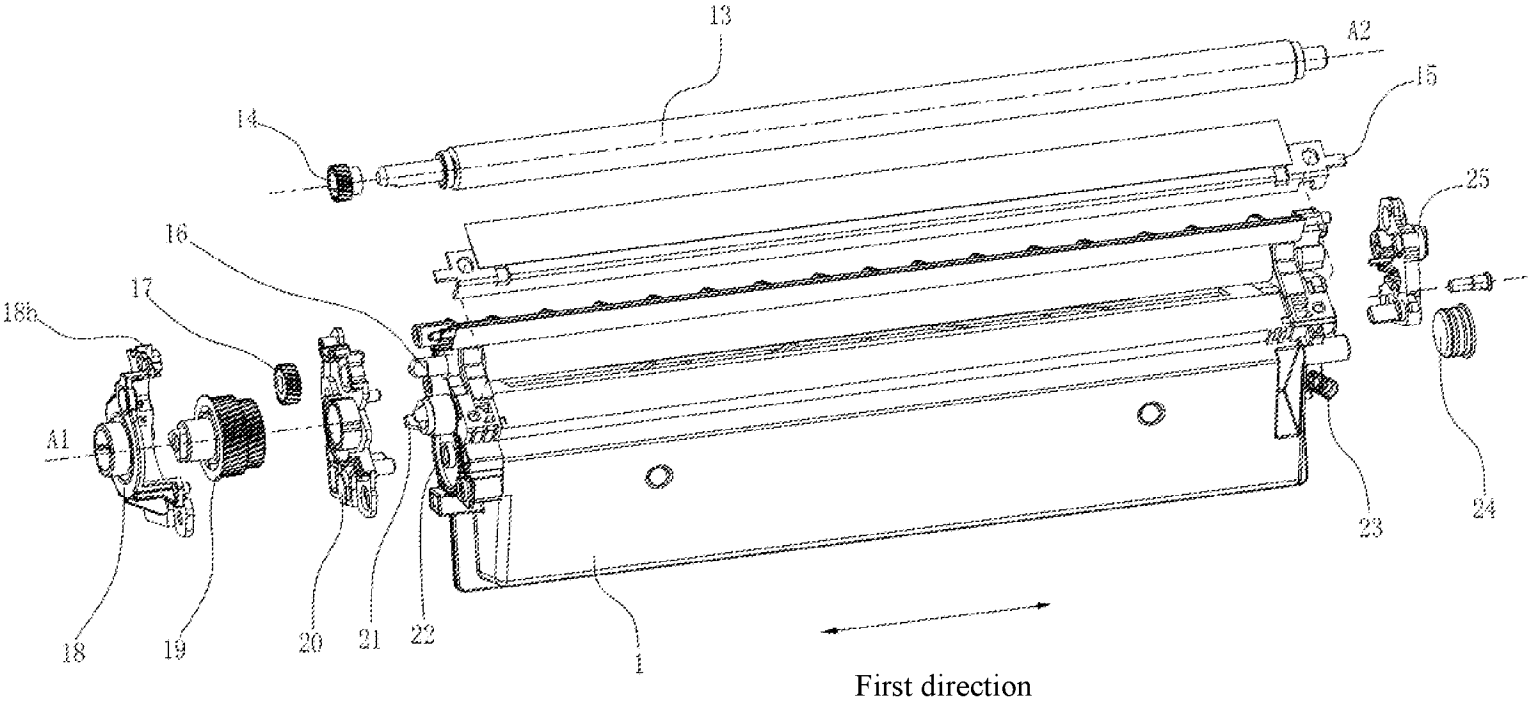
FIG. 3 is an exploded schematic view of components on the first housing of the process cartridge provided by the present invention.
Figure 4:
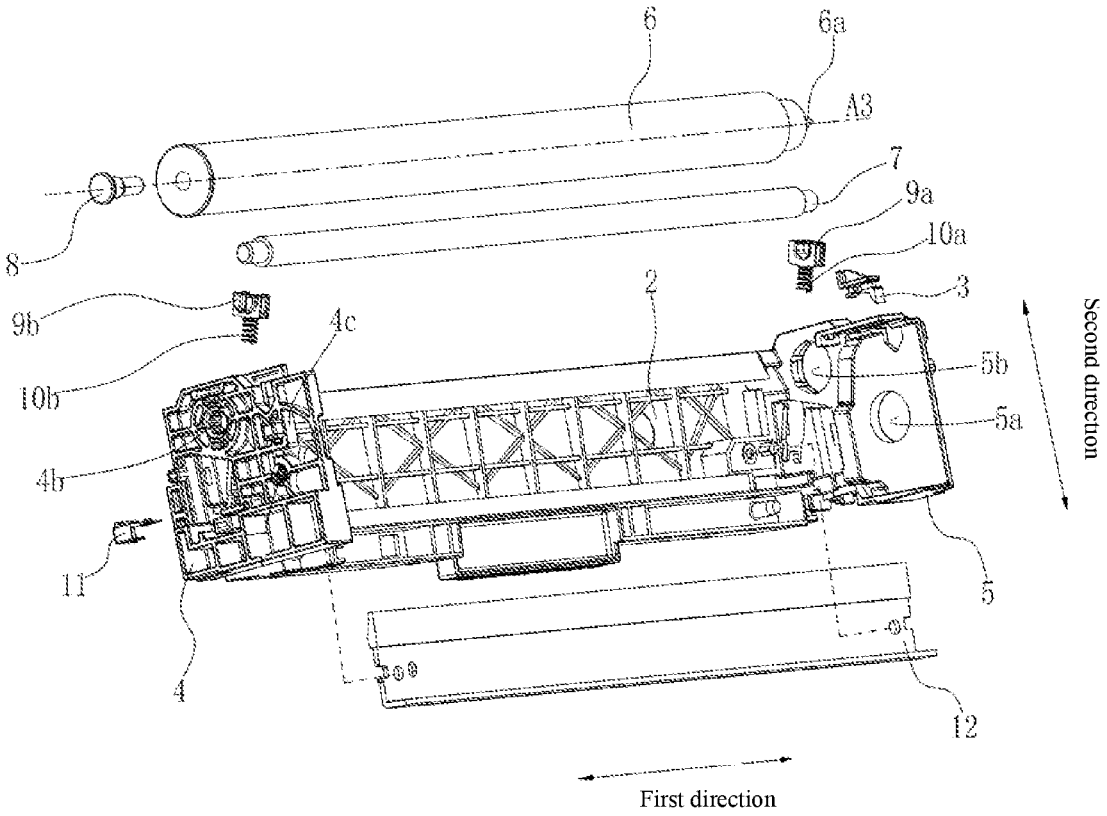
FIG. 4 is an exploded schematic view of components on the second housing of the process cartridge provided by the present invention.

As shown in FIGS. 1 and 2, a process cartridge includes a first housing 1 and a second housing 2 that are combined with each other. The first housing 1 can store a developer required for development, and the second housing 2 can be used to collect the waste developer remaining after development. Two ends of the process cartridge in the first direction are provided with a driving side cover 5 and a conductive end cover portion 4. The driving side cover 5 is used to support a first force receiving portion 19 and a second force receiving portion 6*a* for receiving a driving force transmitted by an electronic imaging device. A first electrical conduction portion 25 and a second electrical conduction portion 11 that can be in contact with a conductive portion (not shown) of the electronic imaging device and receive power are mounted on the conductive end cover portion 4. A separating force receiving component 3 is further provided on the process cartridge. The separating force receiving component 3 is used to separate a photosensitive drum 6 and the developing roller (not shown) in the process cartridge.

First Housing

As shown in FIGS. 1 to 5, the first force receiving portion 19 is mounted on the first housing 1. In the first direction, a first protective portion 18 and a supporting frame 20 are provided on both sides of the first force receiving portion 19, respectively. The first force receiving portion 19 can receive the driving force transmitted by the electronic imaging device to drive a first force transmitting portion 21 to rotate together around the first axis A1 extending in the first direction. A toner supply roller gear 17 and a developing roller gear 14 partially meshed with a gear of the first force receiving portion 19 are further provided in the vicinity of the first force receiving portion 19. The first force receiving portion 19 can drive the toner supply roller gear 17 and the developing roller gear 14 to rotate. The developing roller gear 14 is connected to the developing roller 13, and the developing roller gear 14 can drive the developing roller 13 to rotate around a second axis A2 extending in the first direction. The toner supply roller gear 17 is connected to a toner supply roller 16, and the toner supply roller gear 17 can drive the toner supply roller 16 to rotate. The first force transmitting portion 21 is meshed with a stirring rack gear 22. A doctor blade 15 is mounted in the vicinity of the developing roller 13. The first electrical conduction portion 25 is mounted at an end of the first housing 1 away from the first force receiving portion 19 in the first direction. The first electrical conduction portion 25 is made of a conductive material, such as a conductive resin material, a metal material or the like, and is used for receiving power transmitted from the conductive portion (not shown) of the electronic imaging device and supplying it to at least one of the developing roller 13, the toner supply roller 16 and the doctor blade 15. A sealing portion 24 and a first elastic portion 23 are further provided on the first housing 1. The sealing portion 24 on the first housing 1 can be opened to add the developer into the first housing 1. The first elastic portion 23 allows the developing roller 13 and the photosensitive drum 6 on the process cartridge to maintain a close contact state when the process cartridge is working. In addition, when the first housing 1 is connected to the second housing 2, the first force receiving portion 19 will protrude from a fourth hollow portion 5*a* on the driving side cover 5, and a first forced portion 18*b* that can be in contact with the separating force receiving component 3 is provided on the first protective portion 18.

Second Housing

As shown in FIGS. 1 to 5, the driving side cover 5 and the conductive end cover portion 4 that are located at the two ends of the process cartridge in the first direction, respectively, are integrally molded with a main body part of the second housing 2. Therefore, the driving side cover 5 and the conductive end cover portion 4 are located at two ends of the second housing 2 in the first direction, respectively, thereby becoming a part of the second housing 2. The photosensitive drum 6 is provided on the second housing 2. The second force receiving portion 6*a* is provided at one end of the photosensitive drum 6 in the first direction. The second force receiving portion 6*a* protrudes from the hollow portion 5*b* of the driving side cover 5, and the second force receiving portion 6*a* can receive the driving force transmitted by the electronic imaging device to drive the photosensitive drum 6 to rotate around a third axis A3. A second shaft pin 8 is mounted on the other end of the photosensitive drum 6 in the first direction. The second shaft pin 8 can pass through a third hole 4*b* on the conductive end cover portion 4 to be inserted into the photosensitive drum 6. A charging roller 7 is provided in the vicinity of the photosensitive drum 6. Two sides of the charging roller 7 in the first direction are mounted on a first supporting portion 9*a* and a second supporting portion 9*b*, respectively. The first supporting portion 9*a* and the second supporting portion 9*b* are connected to a second elastic portion 10*a* and a third elastic portion 10*b*, respectively. The second elastic portion 10*a* and the third elastic portion 10*b* allow the charging roller 7 to maintain close contact with the photosensitive drum 6. The second electrical conduction portion 11 on the conductive end cover portion 4 can receive the power transmitted by the conductive portion (not shown) of the electronic imaging device and supply it to the charging roller 7. A cleaning element 12 is mounted on the second housing 2, and the cleaning element 12 is used to clean the remaining developer on the photosensitive drum 6. In addition, the separating force receiving component 3 is mounted on the second housing 2, and the separating force receiving component 3 can move on the second housing 2. Specifically, a side of the second housing 2 in the second direction close to the photosensitive drum 6 is provided with an opening portion 30, and the separating force receiving component 3 is mounted in the opening portion 30 on the second housing 2 for forcing the photosensitive drum 6 and the developing roller 13 in the process cartridge to separate. Preferably, the opening portion 30 is selectively provided on the driving side cover 5. Of course, the opening portion 30 may also be provided on a component that is detachably mounted on the driving side cover 5.

Separating Force Receiving Component

As shown in FIGS. 5 to 10, the separating force receiving component 3 includes a main body portion 3*a*, a first contact portion 3*b*, a second contact portion 3*c*, a guide portion 3*d*, a forced pushing portion 3*e*, and a first limiting portion 3*f*. The main body portion 3*a* can extend in the first direction. The second contact portion 3*c* protrudes from a surface of the main body portion 3*a* and extends in the second direction away from the second housing 2. The second contact portion 3*c* is used to be in contact with a separating member 60 in the electronic imaging device and receive a force from the separating member 60. The first contact portion 3*b* also protrudes from the surface of the main body portion 3*a* and extends in the second direction away from the second housing 2. The first contact portion 3*b* is further in contact with the second contact portion 3*c*. Preferably, an inclined surface is provided on the first contact portion 3*b*. When the separating member 60 is in contact with the first contact portion 3*b*, the inclined surface of the first contact portion 3*b* will press the separating member 60. Of course, the inclined surface on the first contact portion 3*b* may also be provided with other structures, such as a curved surface. In the second direction, the guide portion 3*d* is provided on a side of the main body portion 3*a* opposite to the first contact portion 3*b*, and the guide portion 3*d* is used to guide the movement of the separating force receiving component 3 in the opening portion 30. In order to prevent the separating force receiving component 3 from shaking in the first direction as much as possible, a width L1 of the guide portion 3*d* in the first direction should be equal to a width of a part of the opening portion 30 cooperating with it in the first direction. Preferably, the guide portion 3*d* is selected to be composed of multiple parts arranged at intervals in the third direction. Of course, the guide portion 3*d* may also be selected to be composed of a single part. A side of the guide portion 3*d* in the second direction away from the main body portion 3*a* is connected with the forced pushing portion 3*e*. The forced pushing portion 3*e* extends in the second direction toward the inside of the process cartridge. When the second contact portion 3*c* receives the force from the separating member 60, the separating member 60 will push the separating force receiving component 3 to move in the opening portion 30. Further, the second contact portion 3*c* will drive the forced pushing portion 3*e* to be in contact with the first protective portion 18 and cause the forced pushing portion 3*e* to forcedly push the first protective portion 18. Therefore, the first protective portion 18 drives the first housing 1 to rotate around a center of rotation (not shown) of the first housing 1, so that the developing roller 13 located on the first housing 1 is separated from the photosensitive drum 6 in the second housing 2. The guide portion 3*d* is further connected with the first limiting portion 3*f*. The first limiting portion 3*f* extends in the first direction. The first limiting portion 3*f* is used to limit the displacement of the separating force receiving component 3 in the second direction, so that the separating force receiving component 3 will not fall off from the process cartridge along the second direction in the process of the separating force receiving component 3 forcing the developing roller 13 and the photosensitive drum 6 to separate. Of course, the first limiting portion 3*f* may not need to be separately provided on the separating force receiving component 3, because the forced pushing portion 3*e* also has the function of the first limiting portion 3*f* to prevent the separating force receiving component 3 from falling off from the process cartridge along the second direction, but the provision of the first limiting portion 3*f* can increase the contact area of the separating force receiving component 3 and the process cartridge, so that the force received by the separating force receiving component 3 is more uniform, and thereby the separating force receiving component 3 can move in the opening portion 30 more stably and smoothly.

Opening Portion

Figure 5:
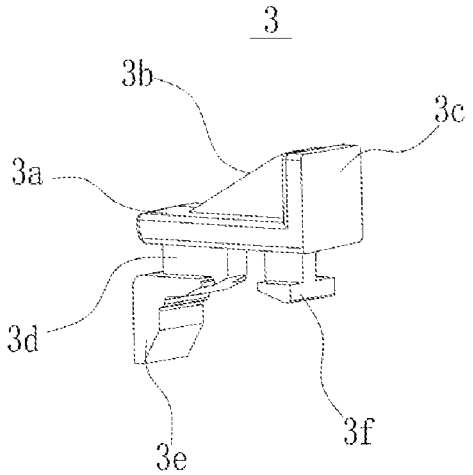
FIG. 5 is a schematic structural view of a separating force receiving component of the process cartridge provided by the present invention.
Figure 6:
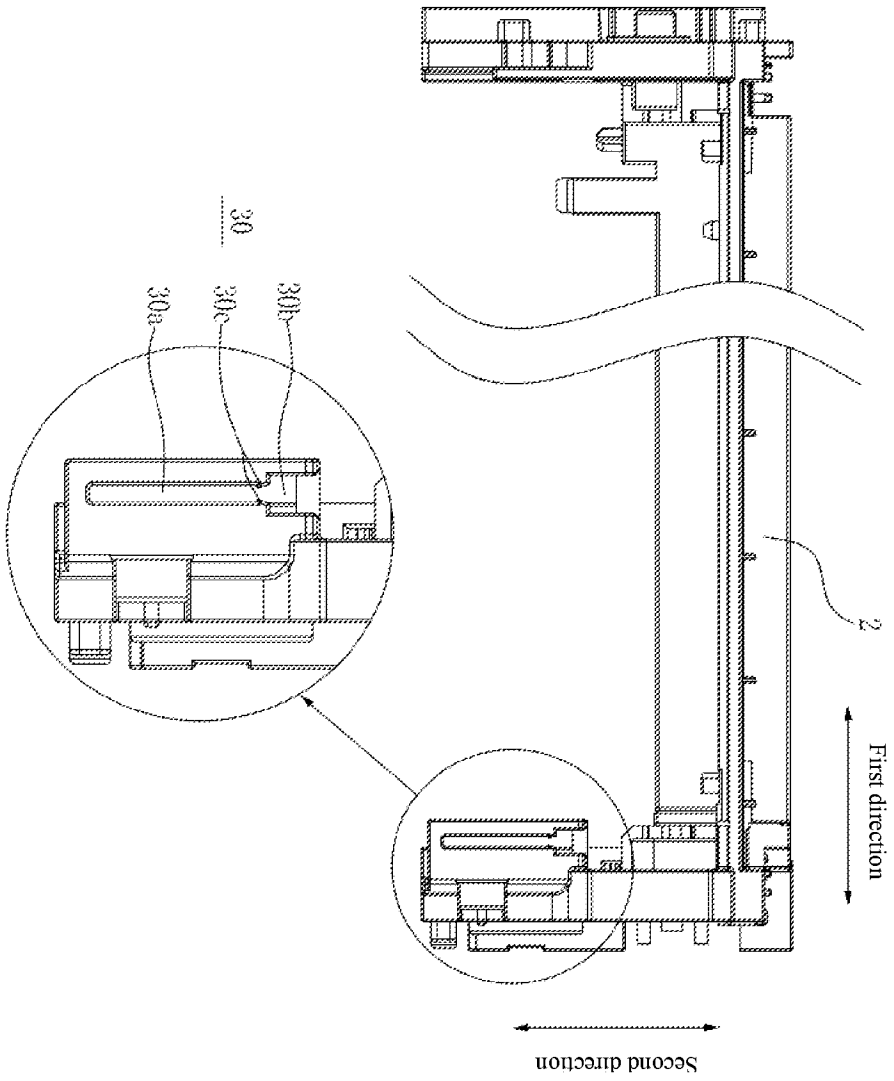
FIG. 6 is a schematic structural view of an opening portion on the second housing of the process cartridge provided by the present invention.
Figure 7:
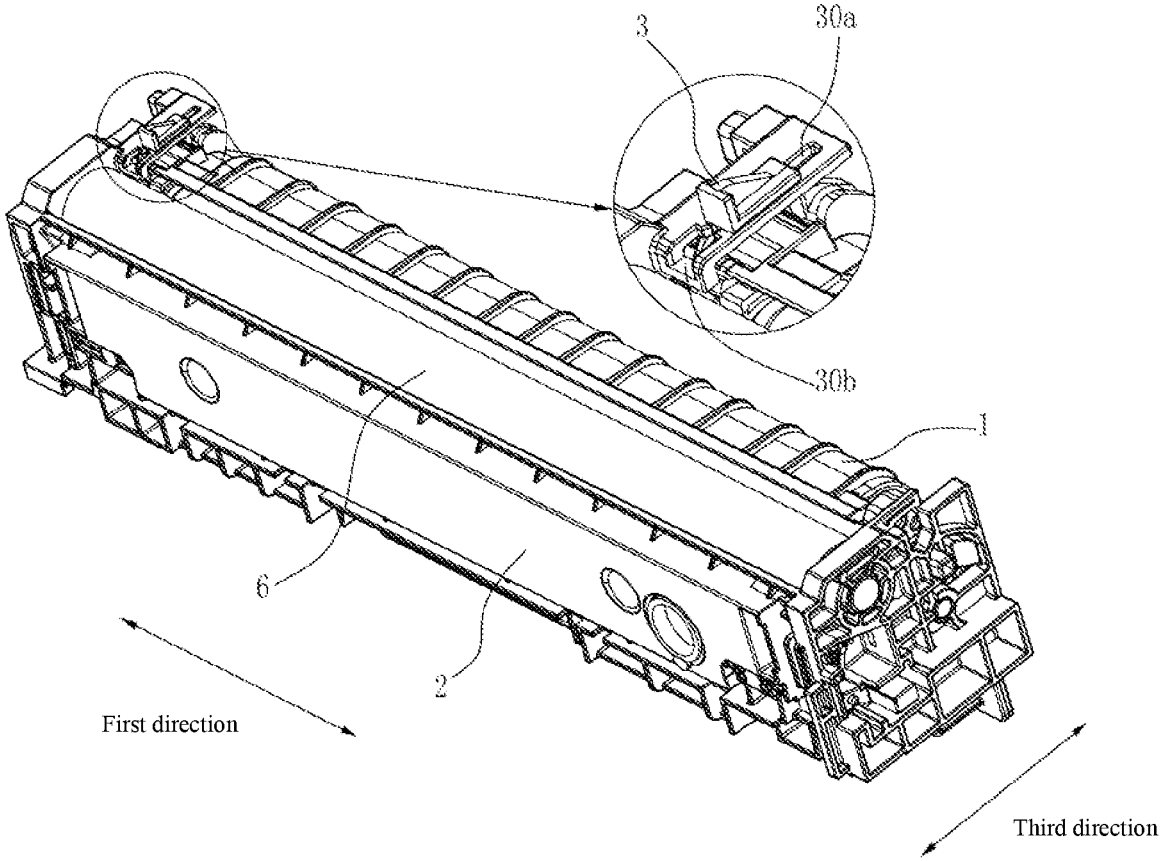
FIG. 7 is a structural schematic diagram and partially enlarged schematic view of the separating force receiving component of the process cartridge provided by the present invention being mounted on the second housing.

As shown in FIGS. 5-7, the opening portion 30 includes a rail portion 30*a*, a mounting portion 30*b*, and a second limiting portion 30*c*. In the first direction, a gap width of the mounting portion 30*b* is larger than a gap width of the rail portion 30*a*, and the gap width of the rail portion 30*a* is greater than a gap width of the second limiting portion 30*c*. The rail portion 30*a* has two opposite surfaces in the first direction. The two surfaces are parallel to the third direction. A distance between the two surfaces of the rail portion 30*a* in the first direction is L2, and L2 is equal to a width L1 of the guide portion 3*d* in the first direction, that is, L2=L1. The second limiting portion 30*c* separately extends outward from two opposite surfaces on the rail portion 30*a*, and the separating force receiving component 3 can be mounted into the opening portion 30 from the mounting portion 30*b*. When the separating force receiving component 3 is pushed from the mounting portion 30*b* into the rail portion 30*a* along the third direction, the guide portion 3*d* of the separating force receiving component 3 will be in contact with the second limiting portion 30*c* and squeeze the second limiting portion 30*c*, thereby allowing the guide portion 3*d* to pass and enter the rail portion 30*a*. When the guide portion 3*d* passes through the second limiting portion 30*c*, the width of the second limiting portion 30*c* in the first direction will return to the width before the increase. Without the support of a certain degree of external force, the guide portion 3*d* can only abut against the second limiting portion 30*c* and cannot pass through the second limiting portion 30*c*, that is, the separating force receiving component 3 mounted in the rail portion 30*a* will not fall off from the opening portion 30 along the third direction. In the direction of gravity, the main body portion 3*a* is located on one side of the rail portion 30*a*, and the first limiting portion 3*f* and the forced pushing portion 3*e* are located on the other side of the rail portion 30*a*. The main body portion 3*a*, the first limiting portion 3*f* and the forced pushing portion 3*e* are all in contact with the rail portion 30*a* to restrict the separating force receiving component 3 from swinging relative to the direction of gravity in the process of moving relative to the second housing 2.

Figure 8:
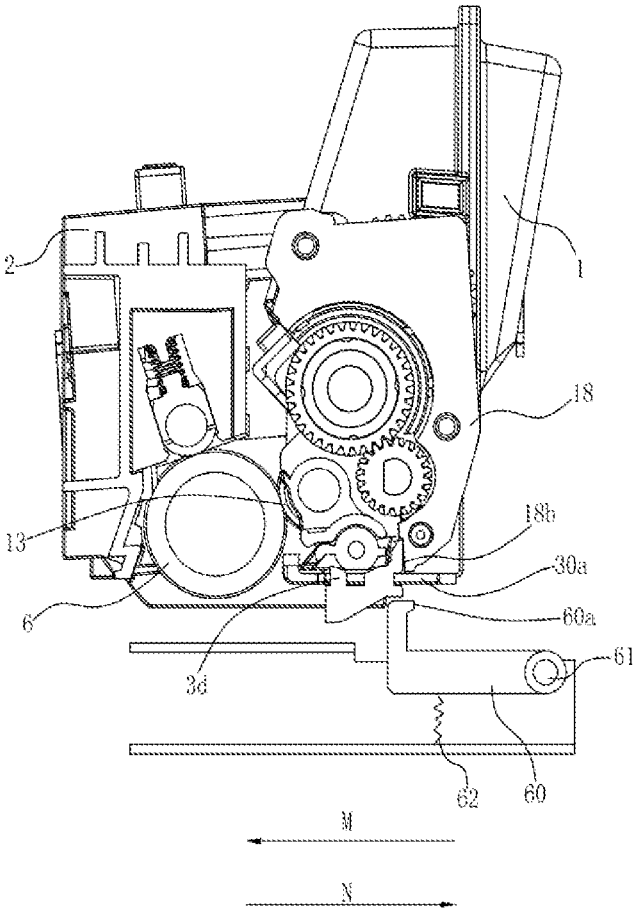
FIG. 8 is a schematic view of a state in which the process cartridge provided by the present invention cooperates with an electronic imaging device.
Figure 9:
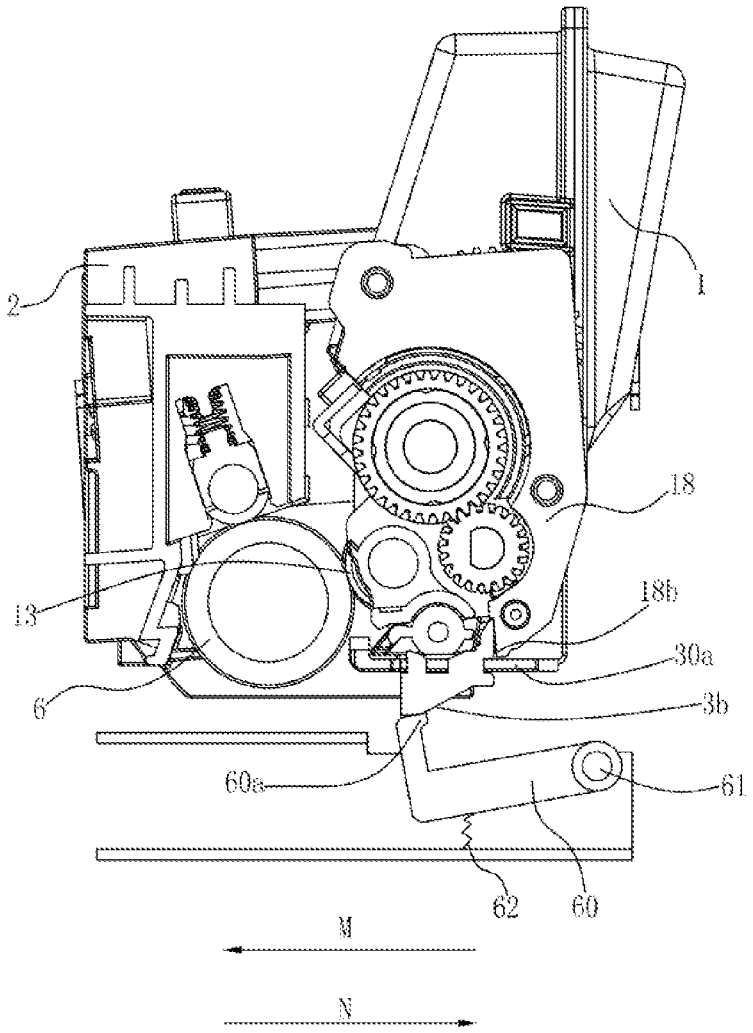
FIG. 9 is a schematic view of a state in which a separating member in the electronic imaging device is pressed by a first contact portion.
Figure 10:
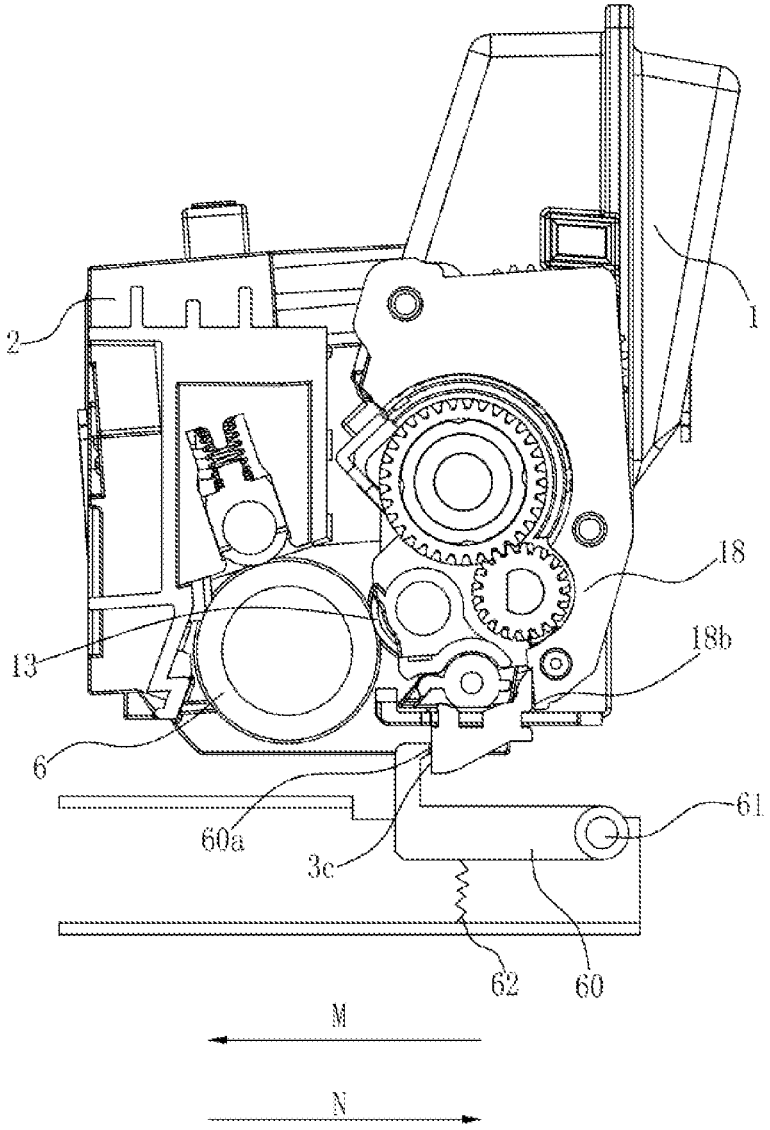
FIG. 10 is a schematic view of a state in which the separating member in the electronic imaging device moves to a side of a second contact portion facing an M direction.
Figure 11:
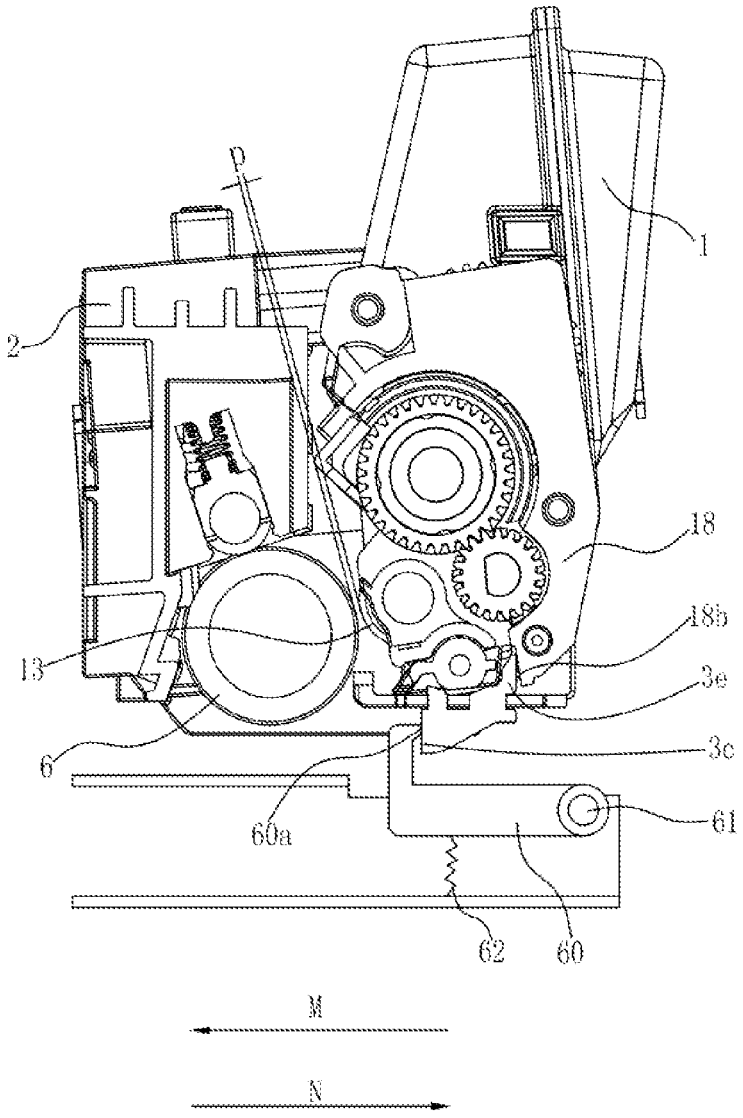
FIG. 11 is a schematic view of the separating member in the electronic imaging device separating a photosensitive drum and a developing roller.
Figure 12:
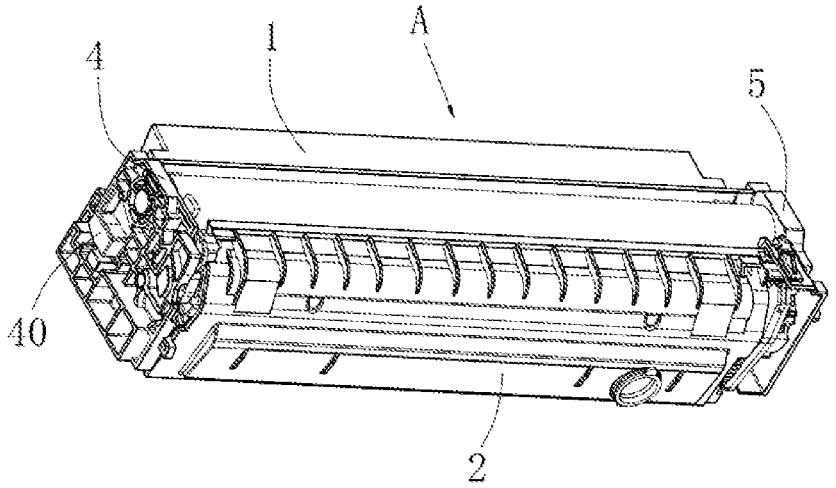
FIG. 12 is a schematic view when a conductive end separating support of the process cartridge in the present invention is mounted.
Figure 13:
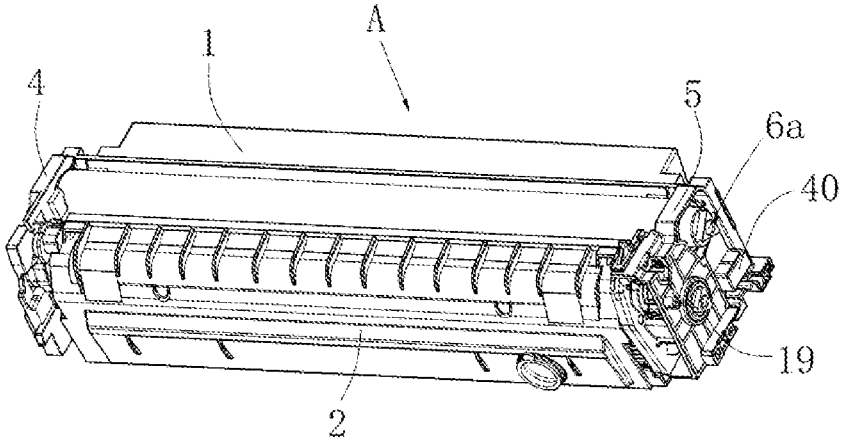
FIG. 13 is a schematic view when a driving end separating support of the process cartridge in the present invention is mounted.
Figure 14:
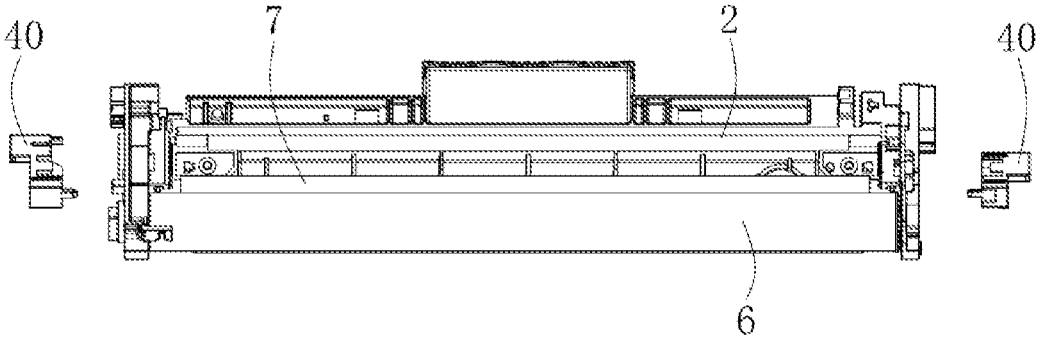
FIG. 14 is a schematic view before a separating support of the process cartridge in the present invention is mounted.
Figure 15:
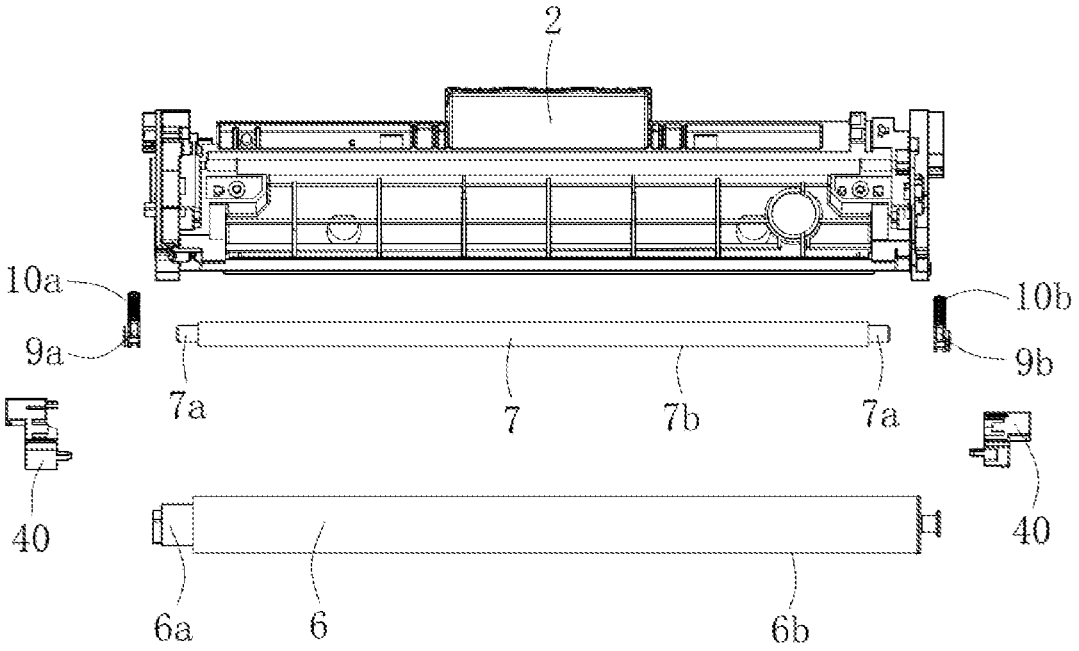
FIG. 15 is an exploded schematic view of the process cartridge in the present invention.
Figure 16:
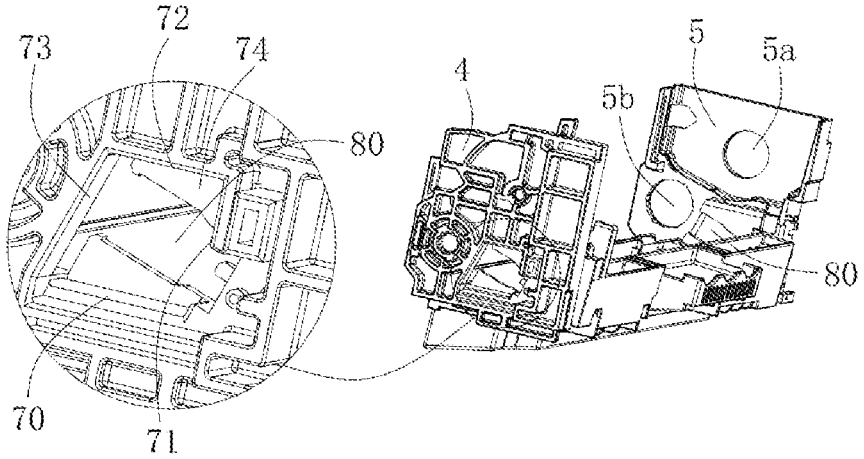
FIG. 16 is a partially enlarged schematic view of the second housing in the present invention.
Figure 17:
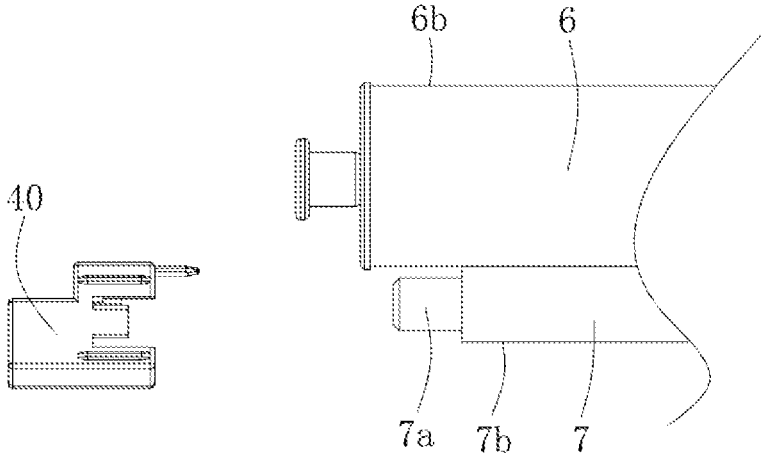
FIG. 17 is a partial schematic view of the separating support being mounted between the photosensitive drum and a charging roller in the present invention.
Figure 18:
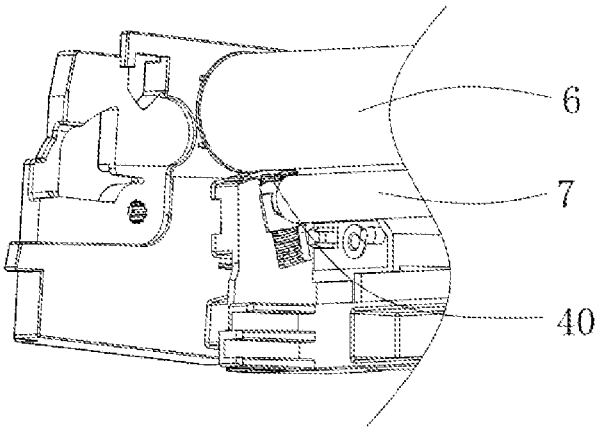
FIG. 18 is a partially enlarged schematic view of a conductive end cover portion in the present invention.
Figure 19:
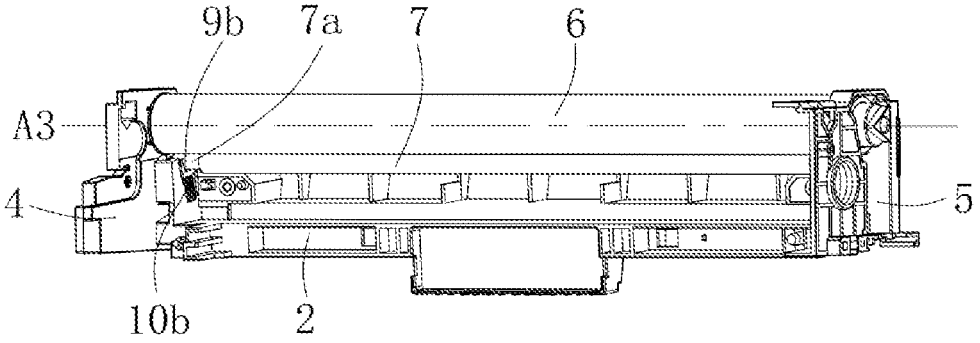
FIG. 19 is a schematic view after the separating support in the present invention is assembled.
Figure 20:
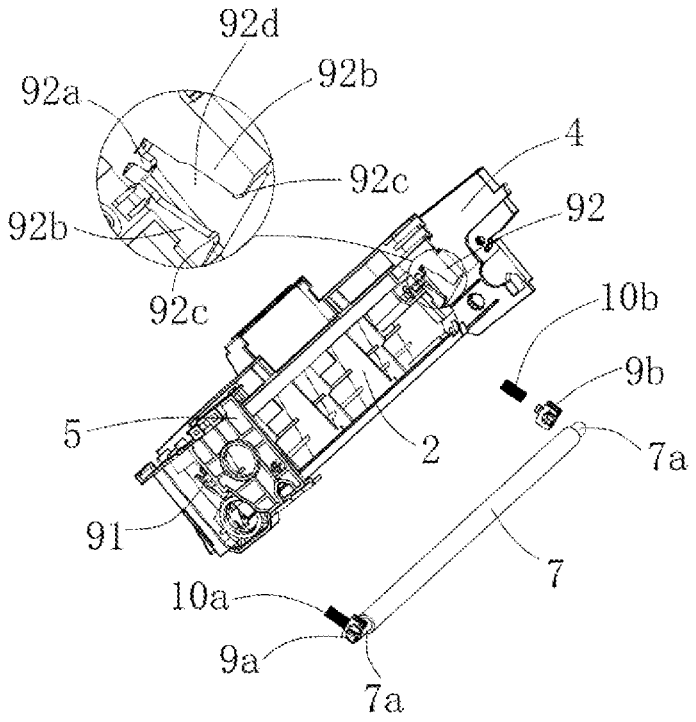

As shown in FIG. 8, the electronic imaging device includes a separating member 60 that can move along the horizontal leftward M direction and the horizontal rightward N direction. A protruding portion 60*a* is provided on the separating member 60, wherein the protruding portion 60*a* is used to be in contact with the separating force receiving component 3, and can push the separating force receiving component 3 to move. The separating member 60 has a center of rotation 61. A fourth elastic portion 62 is provided on one side of the separating member 60 away from the center of rotation 61 for making the separating member 60 move between a predetermined position and a retracted position.

A process of connecting the first housing 1 and the second housing 2 in the process cartridge of the present invention and a process of forcing the photosensitive drum 6 and the developing roller 13 to separate by the separating force receiving component 3 on the process cartridge will be described in detail below according to FIGS. 1-11.

The process of separating the photosensitive drum 6 and the developing roller 13 on the process cartridge is as follows. The inclined surface of the first contact portion 3*b* will press the separating member 60 so that the separating member 60 at the predetermined position overcomes the elastic force of the fourth elastic portion 62 connected to it and rotates around its center of rotation 61 to the retracted position. When the separating member 60 continues to move along the M direction, the separating member 60 will completely pass the first contact portion 3*b*, the first contact portion 3*b* no longer presses the separating member 60, and the elastic force of the fourth elastic portion 62 causes the separating member 60 to rotate along its center of rotation 61 and return to the predetermined position. The protruding portion 60*a* on the separating member 60 returning to the predetermined position is located in the space on a side of the second contact portion 3*c* facing the M direction. Furthermore, the electronic imaging device controls the separating member 60 to move along the N direction. The separating member 60 will be in contact with the second contact portion 3*c* and apply a force along the N direction to the second contact portion 3*c*. The second contact portion 3*c* will move in the rail portion 30*a* of the opening portion 30 under the action of the force. At the same time, the forced pushing portion 3*e* of the separating force receiving component 3 will be in contact with the first forced portion 18*b* of the first protective portion 18 and apply a force along the N direction to the first forced portion 18*b*. Under the action of the force, the first forced portion 18*b* will drive the first housing 1 to rotate around its center of rotation (not shown). That is, the developing roller 13 located in the first housing 1 is separated from the photosensitive drum 6 in the second housing 2. A separation distance between the developing roller 13 and the photosensitive drum 6 is shown as P in FIG. 11. In the above separation process, when the separating member 60 pushes the separating force receiving component 3 to move, because the separating force receiving component 3 always moves along the third direction, the position of the contact point between the separating member 60 and the separating force receiving component 3 is substantially unchanged, that is, the friction loss between the separating member 60 and the separating force receiving component 3 is reduced.

Anti-Contamination Structure of Photosensitive Drum and Charging Roller

As shown in FIGS. 12 to 18, the photosensitive drum 6 has an outer peripheral surface 6*b*. The charging roller 7 includes an inner-layer metal shaft 7*a* and an outer-layer elastic surface 7*b*. An approximately central part of the metal shaft 7*a* is wrapped by the elastic surface 7*b*, and the other part on two sides is exposed. The two sides of the metal shaft 7*a* are mounted on the first supporting portion 9*a* and the second supporting portion 9*b*, respectively. Under the elastic force of the second elastic portion 10*a* and the third elastic portion 10*b*, the elastic surface 7*b* of the charging roller 7 is in contact with the outer peripheral surface 6*b* of the photosensitive drum 6 with a certain pressure.

The conductive end cover portion 4 and the driving side cover 5 are each provided with a separating support mounting port 80 thereon. An opening direction of the separating support mounting port 80 is configured to face the outside of the main body part of the second housing 2 in a length direction. The separating support 40 can be mounted in the separating support mounting port 80 through an opening. The separating support mounting port 80 includes inner walls, and there are multiple inner walls. The inner walls specifically include a first inner wall 70, a second inner wall 71, a third inner wall 72, a fourth inner wall 73, and a barrier wall 74 connected to the first inner wall 70, the second inner wall 71, the third inner wall 72 and the fourth inner wall 73, wherein the first inner wall 70 and the third inner wall 72 are arranged oppositely, the second inner wall 71 and the fourth inner wall 73 are arranged oppositely, and the barrier wall 74 can be used to limit a position in which the mounting of the separating support 40 is terminated.

After the process cartridge A is assembled, the separating support 40 is inserted into the second housing 2 through the separating support mounting port 80, so that the photosensitive drum 6 and the charging roller 7 are separated. When an end user needs to use the process cartridge A, as long as the separating support 40 is disassembled, the contact state between the photosensitive drum 6 and the charging roller 7 can be restored, so that the charging roller 7 can charge the photosensitive drum 6.

It is worth mentioning that the separating support 40 is integrally molded, which can effectively reduce the production cost and assembly time. Considering the cost and practicability, the material of the separating support 40 is preferably plastic. Of course, it is not limiting, and it may also be metal, wood products or the like.

Mounting of First Supporting Portion and Second Supporting Portion

As shown in FIGS. 19 to 24, the second housing 2 further includes a first supporting portion mounting portion 91 and a second supporting portion mounting portion 92. The first supporting portion mounting portion 91 can be used to mount the first supporting portion 9*a*. The second supporting portion mounting portion 92 can be used to mount the second supporting portion 9*b*. Moreover, the first supporting portion mounting portion 91 and the second supporting portion mounting portion 92 are located on the conductive end cover portion 4 and the driving side cover 5, respectively. Of course, it is not limiting, and it may also be provided on the main body part of the second housing 2. The second supporting portion mounting portion 92 includes: a third elastic portion mounting portion 92*a*, wherein one side of the third elastic portion 10*b* can be mounted onto the third elastic portion mounting portion 92*a*; a pair of second supporting portion guide portions 92*b* arranged oppositely, which can be used to guide the mounting of the second supporting portion 9*b*; and a second supporting portion restricting portion 92*c* connected to a side of the second supporting portion guide portion 92*b* facing away from the third elastic portion mounting portion 92*a*, wherein the second supporting portion restricting portion 92*c* can be used to restrict the stroke of the second supporting portion 9*b*. The second supporting portion mounting portion 92 further includes a second supporting portion mounting port 92*d*, which can be used to accommodate the second supporting portion 9*b*. The first supporting portion mounting portion 91 adopts a similar structure to the second supporting portion mounting portion 92, and they are also substantially consistent in function, and the details will not be repeated here. Further, without disassembling the specific components of the process cartridge, when viewed along the third axis A3 of the photosensitive drum 6, the first supporting portion mounting port 91*d* can expose the first supporting portion mounting portion 91, and the second supporting portion mounting port 92*d* can expose the second supporting portion mounting portion 92. Further, the second housing 2 including the main body part of the second housing 2, the conductive end cover portion 4, the driving side cover 5, the second supporting portion mounting portion 92, and the first supporting portion mounting portion 91 are integrally molded. That is, the second housing 2 can be produced with only one set of molds, which greatly reduces the production cost and improves the assembly efficiency of the process cartridge.

Both the first supporting portion 9*a* and the second supporting portion 9*b* are made of conductive materials. Preferably, considering the cost and practicability, both the materials of the first supporting portion 9*a* and the second supporting portion 9*b* are selected as conductive resin. Optionally, the materials may also be copper, aluminum, conductive ceramics or the like. The second supporting portion 9*b* is mounted on the second supporting portion mounting portion 92 on the conductive end cover portion 4. The second supporting portion 9*b* includes a fourth elastic mounting portion 9*b*1, which can abut against a side of the third elastic portion 10*b*. That is, the third elastic portion 10*b* abuts between the third elastic portion mounting portion 92*a* and the fourth elastic mounting portion 9*b*1. The second supporting portion 9*b* further includes a pair of sliding grooves 9*b*2, which are symmetrically arranged on two opposite sides of the second supporting portion 9*b*. Moreover, the pair of sliding grooves 9*b*2 have the same width and depth. The sliding grooves 9*b*2 can be used to mount and guide the second supporting portion 9*b*. Under the restriction of the stroke of the second supporting portion restricting portion 92*c*, the second supporting portion 9*b* can be relatively far away from or close to the third axis A3 of the photosensitive drum 6. The first supporting portion 9*a* is mounted on the first supporting portion mounting portion 91 on the driving side cover 5, wherein the structure and function of the first supporting portion 9*a* are similar to those of the second supporting portion 9*b*. During assembly, both the first supporting portion 9*a* and the second supporting portion 9*b* are provided so as to be universally mounted on the first supporting portion mounting portion 91 and the second supporting portion mounting portion 92. Through the universal use of the first supporting portion and the second supporting portion, the number of molds for producing the first supporting portion 9*a* and the second supporting portion 9*b* can be further reduced, thereby reducing the cost.

Mounting of Process Cartridge

As shown in FIGS. 8, and 25 to 27, a process of mounting the process cartridge A into an electronic imaging device B will be introduced. The electronic imaging device B includes a movable tray 52 and a main body accommodating portion 51. The tray 52 can be drawn out and pushed in from the main body accommodating portion 51. When the tray 52 is drawn out, the process cartridge A can be mounted in the tray 52 and pushed together with the tray 52 into the main body accommodating portion 51 of the electronic imaging device. The tray 52 includes a plurality of accommodating cavities 53 for accommodating the process cartridge A. Each accommodating cavity 53 is provided with a supporting portion 54 for supporting the process cartridge therein. A supported portion 27 is provided on the process cartridge. When the process cartridge A is mounted in the tray 52, the process cartridge A is supported on the tray 52 by the supported portion 27 contacting the supporting portion 54. In the direction of gravity, the supported portion 27 of the process cartridge is arranged at an upper end of the separating force receiving component 3, and at the same time, at a lower end of the first force receiving portion 19. Moreover, the supported portion 27 is arranged adjacent to the separating force receiving component 3. This arrangement can ensure that in the process of pushing the process cartridge A into the main body accommodating portion 51 along with the tray 52, the separating force receiving component 3 can be maintained at an upper end of the separating member 60 and will not interfere with the separating member 60.

In the process cartridge of the present invention, the driving side cover and the conductive end cover portion are integrally molded with the second housing, and the movable separating force receiving component is mounted on the second housing, which reduces the complexity of the structure of the process cartridge so that the connection between the first casing and the second casing is simpler and easier to operate, and reduces the parts required for the connection between the first casing and the second casing, thereby reducing the production cost of the process cartridge. At the same time, when the electronic imaging device drives the separating member to push the separating force receiving component to separate the photosensitive drum and the developing roller in the process cartridge, the position of the contact point between the separating member and the separating force receiving component remains substantially unchanged, which reduces the friction loss between the separating member and the separating force receiving component, and prolongs the service life of the separating member and the separating force receiving component.

The above embodiments are only used to illustrate the technical solutions of the present invention, and are not intended to be limiting. Although the present invention has been described in detail with reference to the foregoing embodiments, it should be understood by those of ordinary skill in the art that it is still possible to made modifications of the technical solutions described in the foregoing embodiments or equivalent replacements of some technical features therein. However, these modifications or replacements do not cause the essence of corresponding technical solutions to deviate from the spirit and scope of the technical solutions of the embodiments of the present invention.

What is claimed is:

1. A process cartridge, which is detachably mounted into an electronic imaging device, wherein the electronic imaging device comprises a separating member, a movable tray, and a main body accommodating portion, and the tray can be drawn out and pushed in from the main body accommodating portion, the process cartridge comprising:

a photosensitive drum having a photosensitive layer on its surface;

a charging roller for charging the photosensitive drum;

a developing roller for developing an electrostatic latent image formed on the surface of the photosensitive drum, which rotates around an axis extending in a first direction;

a first housing supporting the developing roller, in which an accommodating portion for accommodating a developer is provided;

a second housing supporting the photosensitive drum, wherein when the process cartridge is mounted into the electronic imaging device, in a direction of gravity, the photosensitive drum is positioned on a lower end side of the process cartridge, and an axis of the developing roller is positioned on an upper side of an axis of the photosensitive drum;

a first force receiving portion, which can receive a driving force in the electronic imaging device for driving the developing roller to rotate;

a second force receiving portion, which can receive a driving force in the electronic imaging device for driving the photosensitive drum to rotate; and a cleaning element mounted on the second housing for cleaning the developer remaining on the photosensitive drum, wherein the process cartridge further comprises a driving side cover and a separating force receiving component that can receive an external force from the outside of the process cartridge to move; a rail portion is provided on the driving side cover, and the separating force receiving component can cooperate with the rail portion to slide along the rail portion; the separating force receiving member receives the external force to slide so as to drive the first housing to move relative to the second housing, so that the developing roller is separated from the photosensitive drum; a supporting portion supporting the process cartridge is provided on the tray, and a supported portion supported by the supporting portion is provided on the process cartridge; and in the direction of gravity, the supported portion is provided between the separating force receiving component and the first force receiving portion.

2. The process cartridge according to claim 1, wherein the second housing comprises a main body portion integrally molded with the driving side cover, the cleaning element is mounted on the main body portion, two hollow portions are provided on the driving side cover, and the first force receiving portion and the second force receiving portion respectively protrude from the two hollow portions.

3. The process cartridge according to claim 1, further comprising a supporting portion for supporting the charging roller, wherein a supporting portion mounting portion for mounting the supporting portion is further provided on the second housing, and a supporting portion mounting port exposing the supporting portion mounting portion is further provided on the driving side cover.

4. The process cartridge according to claim 3, further comprising an separating support, wherein an separating support mounting port is provided on the second housing, the separating support is inserted into the second housing through the separating support mounting port, and the separating support mounting port exposes the supporting portion.

5. The process cartridge according to claim 1, wherein a first contact portion is further provided on the separating force receiving component, an inclined surface is provided on the first contact portion, and when the process cartridge is mounted into the electronic imaging device, the inclined surface can press the separation member so that the separating member is rotated to a retracted position.

6. The process cartridge according to claim 5, wherein the separating force receiving component is further provided with a second contact portion for contacting the separating member and receiving a force for separating the photosensitive drum and the developing roller thereon, and the first contact portion is adjacent to the second contact portion.

* * * * *